US007284919B2

(12) United States Patent
Kinoshita

(10) Patent No.: US 7,284,919 B2
(45) Date of Patent: Oct. 23, 2007

(54) PRINTING APPARATUS AND CONTROL METHOD

(75) Inventor: Yoshiaki Kinoshita, Hata-machi (JP)

(73) Assignee: Seiko Epson Corporation (JP)

( * ) Notice: Subject to any disclaimer, the term of this patent is extended or adjusted under 35 U.S.C. 154(b) by 456 days.

(21) Appl. No.: 10/897,628

(22) Filed: Jul. 23, 2004

(65) Prior Publication Data

US 2005/0243332 A1 Nov. 3, 2005

(30) Foreign Application Priority Data

Jul. 28, 2003 (JP) ..... 2003-202636

(51) Int. Cl.
*B41J 11/44* (2006.01)

(52) U.S. Cl. ..... 400/76; 400/70; 358/1.15

(58) Field of Classification Search ..... 400/76, 400/70; 358/1.15
See application file for complete search history.

(56) References Cited

U.S. PATENT DOCUMENTS

| | | | |
|---|---|---|---|
| 5,594,653 | A | 1/1997 | Akiyama et al. |
| 5,911,527 | A | 6/1999 | Aruga et al. |
| 5,987,224 | A | 11/1999 | Koakutsu et al. |
| 6,198,985 | B1 | 3/2001 | Miyasaka et al. |
| 6,205,363 | B1 | 3/2001 | Miyasaka et al. |
| 6,208,906 | B1 | 3/2001 | Miyasaka et al. |
| 6,257,783 | B1 | 7/2001 | Hanaoka et al. |
| 6,360,135 | B1 | 3/2002 | Miyasaka et al. |
| 6,362,896 | B1 | 3/2002 | Miyasaka et al. |
| 6,434,445 | B2 | 8/2002 | Miyasaka et al. |
| 6,453,208 | B2 | 9/2002 | Miyasaka et al. |
| 6,697,678 | B2 | 2/2004 | Miyasaka et al. |
| 2001/0024585 | A1 | 9/2001 | Koakutsu et al. |

FOREIGN PATENT DOCUMENTS

| | | |
|---|---|---|
| JP | 04-269575 | 9/1992 |
| JP | 07-186494 | 7/1995 |
| JP | 10-119391 | 12/1998 |
| JP | 2000-344428 | 12/2000 |
| JP | 2002-200804 | 7/2002 |

*Primary Examiner*—Minh Chau
(74) *Attorney, Agent, or Firm*—Anderson Kill & Olick, PC

(57) ABSTRACT

A printer capable of printing to both roll paper and slips. The printer includes a condition setting unit 15 for setting or not setting the absence of roll paper in the printer as a set condition for taking the printer off-line. An off-line status determination circuit 16 for generating an output in response to the set condition of the condition setting unit 15 when the power is turned on or reset, and a print controller responsive to the output from said off-line status determination circuit for determining whether to set the printer to be taken off-line or not according to the set condition of the condition setting unit . Accordingly, when roll paper is not needed, the printer can thus print to slips without ever loading roll paper.

11 Claims, 6 Drawing Sheets

PRINTING APPARATUS AND CONTROL METHOD

BACKGROUND OF THE INVENTION

1. Field Of Technology

The present invention relates to a printer and control method for printing to slips, validation tickets, and other single sheet forms as well as printing to roll paper.

2. Description Of Related Art

Printers such as POS printers and teller terminal printers typically use roll paper for example., as the printing medium for printing receipts. Some printers can also print to checks, slips, validation tickets, and other single-sheet forms at the same time. These printers must be able to accurately print the print data sent from a host device, and roll paper is the most common print medium used. If roll paper is absent when the power is turned on the roll paper supply is depleted during operation, prior-art printers of this type typically go off-line, and prevent print commands and print data from being sent from the host device. See, for example, Japanese Unexamined Patent Appl. Pub. H10-119391.

There are also POS printers having both a receipt printing mechanism and a journal printing mechanism that switch printing to receipt paper or journal paper according to a command from the host device and go off-line if the selected printing paper, that is, receipt paper or journal paper, runs out, but do not go off-line if the supply of printing paper that is not selected runs out. See, for example, Japanese Patent 2987958.

Depending upon the actual conditions where this printer is used, however, the printer may be used only for printing slips and may never be used for printing to roll paper. When a printer according to the prior art that takes the printer off-line when roll paper is not loaded is used in this operating environment, the printer is rendered unable to print to single sheets, including slips and checks, if roll paper is not loaded in the printer even though the printer only prints to single sheets.

In thermal printers in which the roll paper is always held between a line thermal head and the platen, it does not matter if there is slack in the roll paper when the power is turned on, even with drop-in type roll paper loading systems. However, when inkjet printers using an inkjet head or serial impact dot matrix printers use a drop-in loading roll paper feed mechanism, slack tends to develop in the roll paper regardless of how the roll paper is held when the power turns on because tension is not applied to the paper as it is in a thermal printer. When the roll paper is loaded, the paper is advanced slightly and cut when the power is turned on in order to remove this slack. This obviously wastes roll paper.

Furthermore, because drop-in-loading roll paper printers cannot convey the roll paper in reverse, roll paper is wasted each time the power is turned off and on again.

The prior art that selects whether to print to journal paper or receipt paper and takes the printer off-line even when the printing paper that is not selected runs out confirms whether the journal paper and receipt paper are loaded when the power is turned on or reset, and takes the printer off-line when the journal paper and/or receipt paper runs out. Therefore, even when there is no plan to print to roll paper, journal paper and/or receipt paper must be loaded to prevent the printer going off-line when the power is turned on or reset, and both time and money are wasted.

The printing apparatus of the present invention does not require roll paper to be loaded if there is no expectation of printing to roll paper.

SUMMARY OF THE INVENTION

The present invention solves the foregoing problem by providing a condition setting unit for setting or not setting the absence of roll paper as a condition for taking the printing apparatus off-line; an off-line status determination circuit for generating an output responsive to the set condition of the condition setting unit when the power is turned on or reset, and a print controller responsive to the output from said off-line status determination circuit for determining whether to set the printing apparatus to be taken off-line or not according to the set condition in the condition setting unit.

A printing apparatus according to a first implementation of the present invention for printing to roll paper and slips, comprising a roll paper detector for detecting presence or absence of roll paper, a condition setting unit for setting or not setting the absence of roll paper as a condition for taking the printing apparatus off-line; and an off-line status determination circuit for determining the set condition of the condition setting unit in response to when the power is turned on or reset, and a print controller responsive to said off-line status determination circuit for determining whether to set the printing apparatus off-line according to the set condition in the condition setting unit. When roll paper is not needed for printing, this printer can print to slips without ever loading roll paper in the printer.

The condition setting unit is preferably a logical switch for storing settings information in a nonvolatile storage means. This logical switch can be set manually by an operation on the operating panel of the printer, or programmatically by a command applied from a host device.

Alternatively, the condition setting unit is a physical switch such as a DIP switch. By using a physical switch, the off-line conditions can be dependably set at any time by a manual operation.

A first implementation of a control method for a printing apparatus for printing to roll paper and slips, and having a roll paper detector for detecting presence or absence of roll paper, has steps of (a) a step of setting or not setting the absence of roll paper as an off line condition of operation of the printing apparatus; b) confirming when the power is turned on or reset before determining whether the absence of roll paper has been set as an off-line condition, and (c) determining whether to take the printing apparatus off-line in the absence of roll paper based upon the determination in step (b). This printing apparatus control method further preferably has (d) a step of ignoring a roll paper selection command when the roll paper selection command is received when roll paper absence is set as not a condition for going off-line.

Yet further preferably, this printing apparatus control method has (e) a step of returning a roll paper present status regardless of actual roll paper detection when a status request is received if roll paper absence is set as not a condition for going off-line. Because this implementation thus does not return a no-roll-paper status signal, the application does not need to process status signals, and the present invention can therefore be used with legacy applications without changing the application.

The present invention can also be implemented using a computer-readable recording medium containing a program to be executed on a computer for carrying out each of the steps of the control method or can be implemented using a computer which includes a CPU, logic circuits, memory, and a control program for executing the steps of the control method.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
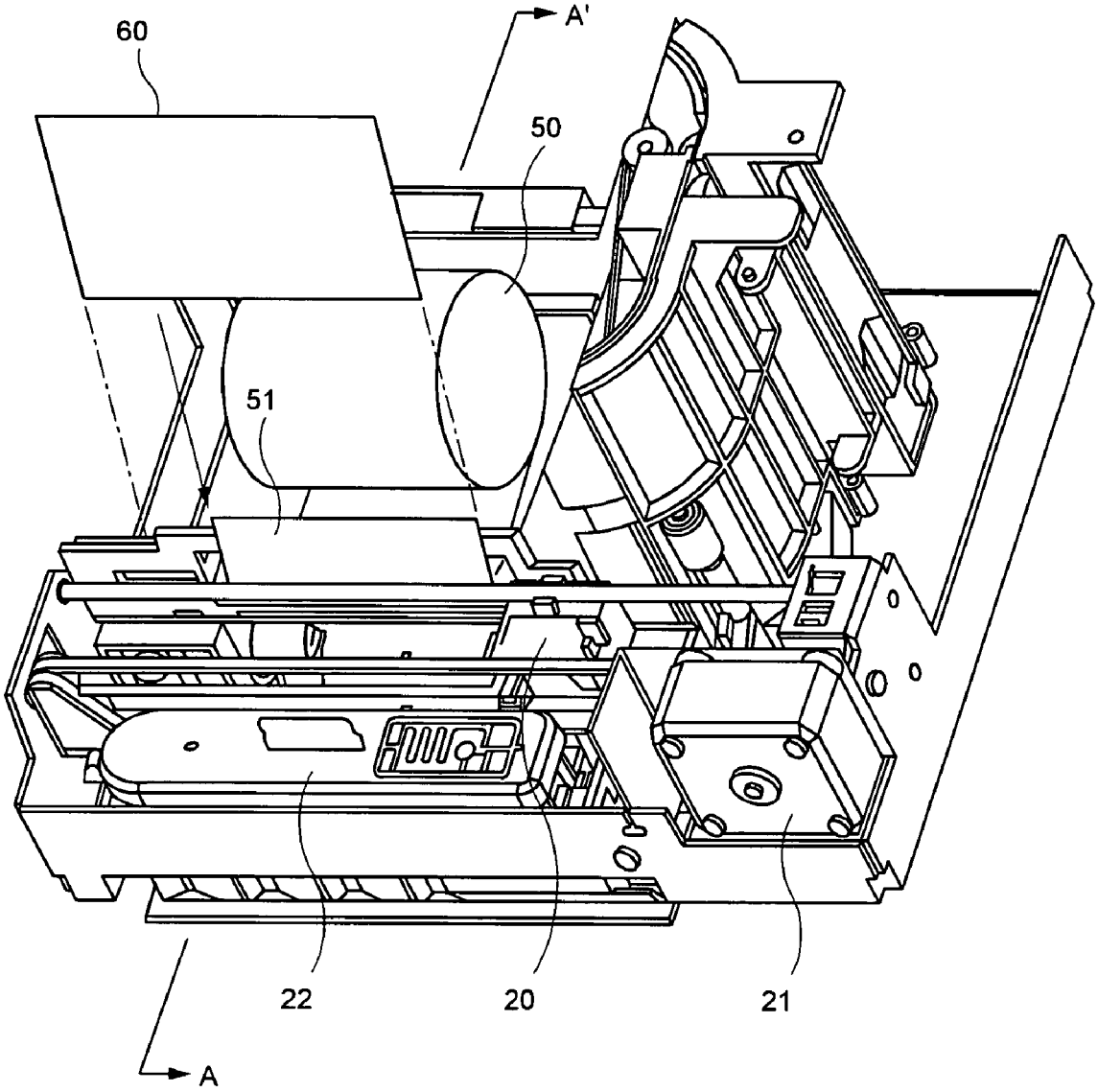
FIG. 1 is an oblique view of a printer according to a preferred implementation of the present invention with the cover removed.
Figure 2:
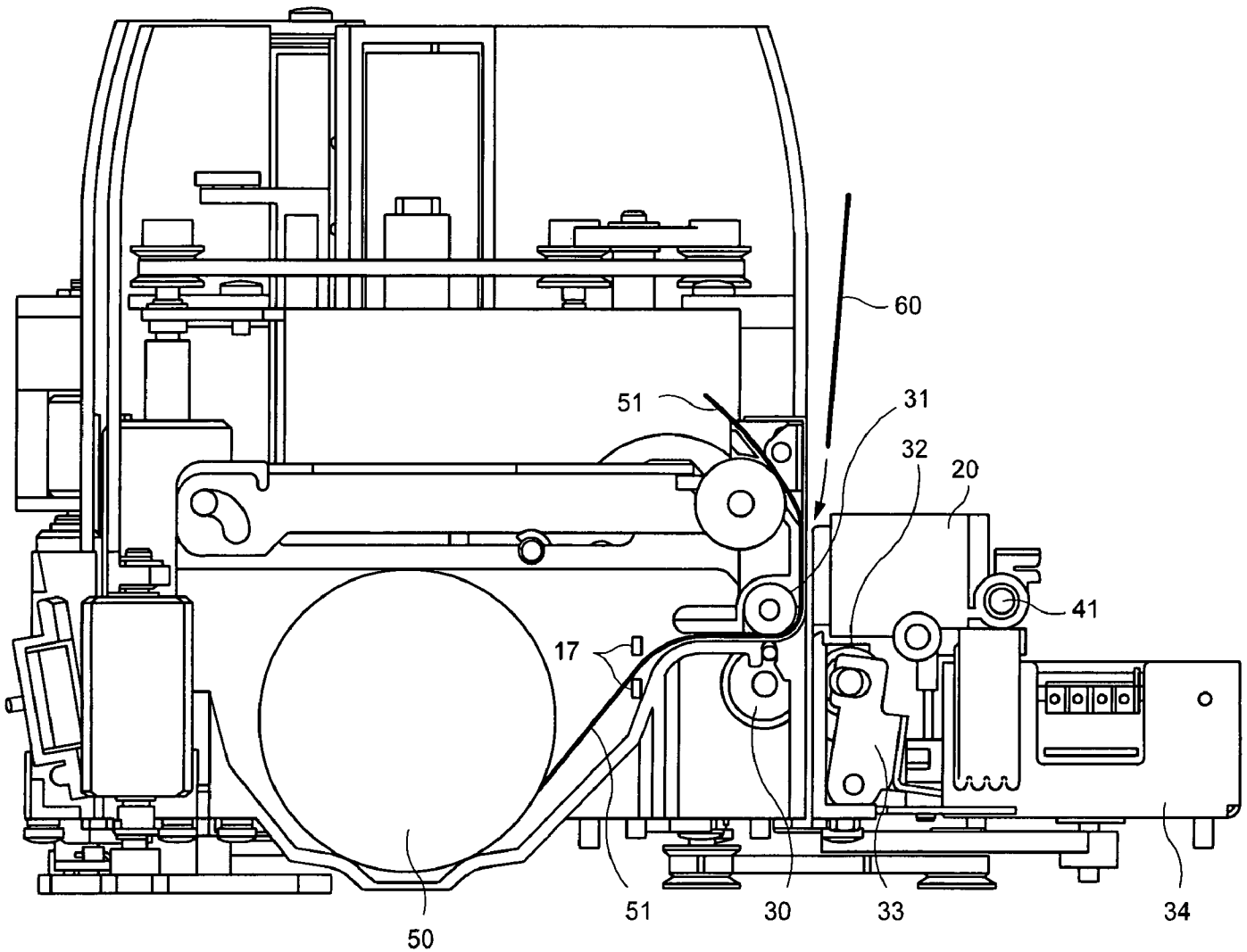
FIG. 2 is a section view through line A–A' in FIG. 1.

Preferred embodiments of the present invention are described below with reference to the accompanying figures. FIG. 1 is an oblique view of a printer according to a preferred implementation of the present invention with the cover removed, and does not show those parts that are not needed to describe the present invention. FIG. 1 and FIG. 2 show only those parts necessary to describe the roll paper location, roll paper transportation path, and slip insertion direction, and only those parts are labeled and described below.

Referring to FIG. 1, the print head 20 has a plurality of inkjet nozzles, and travels laterally right-left as seen in FIG. 1 on a shaft 41 shown in FIG. 2. The carriage motor 21 moves the print head 20 right-left along this shaft 41. Ink stored in an ink tank 22 is supplied to the inkjet nozzles of the print head 20.

Roll paper 51 is wound into a roll 50, and the roll paper 51 leader pulled from the roll 50 is delivered in the direction of the print head 20 as shown in FIG. 2. The pair of transportation rollers 30, 31 shown in FIG. 2 is disposed to hold the roll paper 51 so that when the one transportation roller 30 is driven clockwise, the roll paper 51 is pulled from the roll 50 in the direction of the print head 20. When the roll paper 51 has advanced to a predefined position, the print head 20 moves to the left from the position shown in FIG. 1 and prints widthwise to the roll paper 51. The number of lines printed each time the print head 20 travels widthwise to the paper is determined by the number of ink nozzles on and the structure of the print head 20.

If one line is printed each time the print head traverses the paper, one line is printed each time the print head 20 passes once over the roll paper 51. When printing one line is finished, the roll paper 51 is advanced the distance equal to one line by the transportation rollers 30, 31, and the print head 20 then travels from left to right and prints the next line. This operation is repeated as needed to print to the roll paper 51.

Printing to a slip or validation form is described next. As shown in FIG. 1 and FIG. 2, a slip 60 is inserted to the same printing mechanism portion that prints the roll paper 51 pulled thereto with the side of the slip 60 to be printed facing the print head 20. The slip 60 is printed in the same way that the roll paper 51 is printed. That is, the slip 60 is printed horizontally by means of the print head 20 moved left-right over the slip 60 surface, and is printed vertically by means of the transportation roller 30 and pressure roller 32 advancing the slip 60 as needed. The roll paper 51 is behind the slip 60 when the slip 60 is set (inserted) to the print mechanism, and the roll paper 51 is therefore not printed when the slip 60 is printed.

The pressure roller 32 is disposed to a drive arm 33, and the drive arm 33 is driven by a solenoid or other drive device 34. When the drive device 34 drives the drive arm 33, the pressure roller 32 moves to the left as seen in FIG. 2. When printing to a slip 60, the drive arm 33 is driven, and the slip 60 is held between the transportation roller 30 and pressure roller 32. The slip 60 can thus be conveyed upward by turning the transportation roller 30 counterclockwise.

If the roll paper 51 runs out in this type of printer, a roll paper detector 17 detects that there is no roll paper loaded. If printing is allowed when there is no roll paper and roll paper is selected for printing, not only will the content not be printed correctly, but the ink discharged from the ink nozzles will also soil the surrounding area. As a result, printing is stopped, the printer is taken off-line, and sending data from the host device is prohibited when there is no roll paper loaded.

Depending upon the operating environment, however, this type of printer may be used only for printing to slips 60. If in this situation the printer goes off-line because no roll paper 51 is loaded, slip printing is also disabled unless roll paper 51 is loaded even though there is no need to print to roll paper 51. This imposes an unnecessary burden on the user.

A printer according to the present invention can therefore be configured so that the absence of roll paper 51 is not a condition for taking the printer off-line, or the absence of roll paper 51 is a condition for taking the printer off-line. If the absence of roll paper 51 is not a condition for taking the printer off-line, the printer does not go off-line when there is no roll paper 51. This is further described with reference to FIG. 3.

Figure 3:
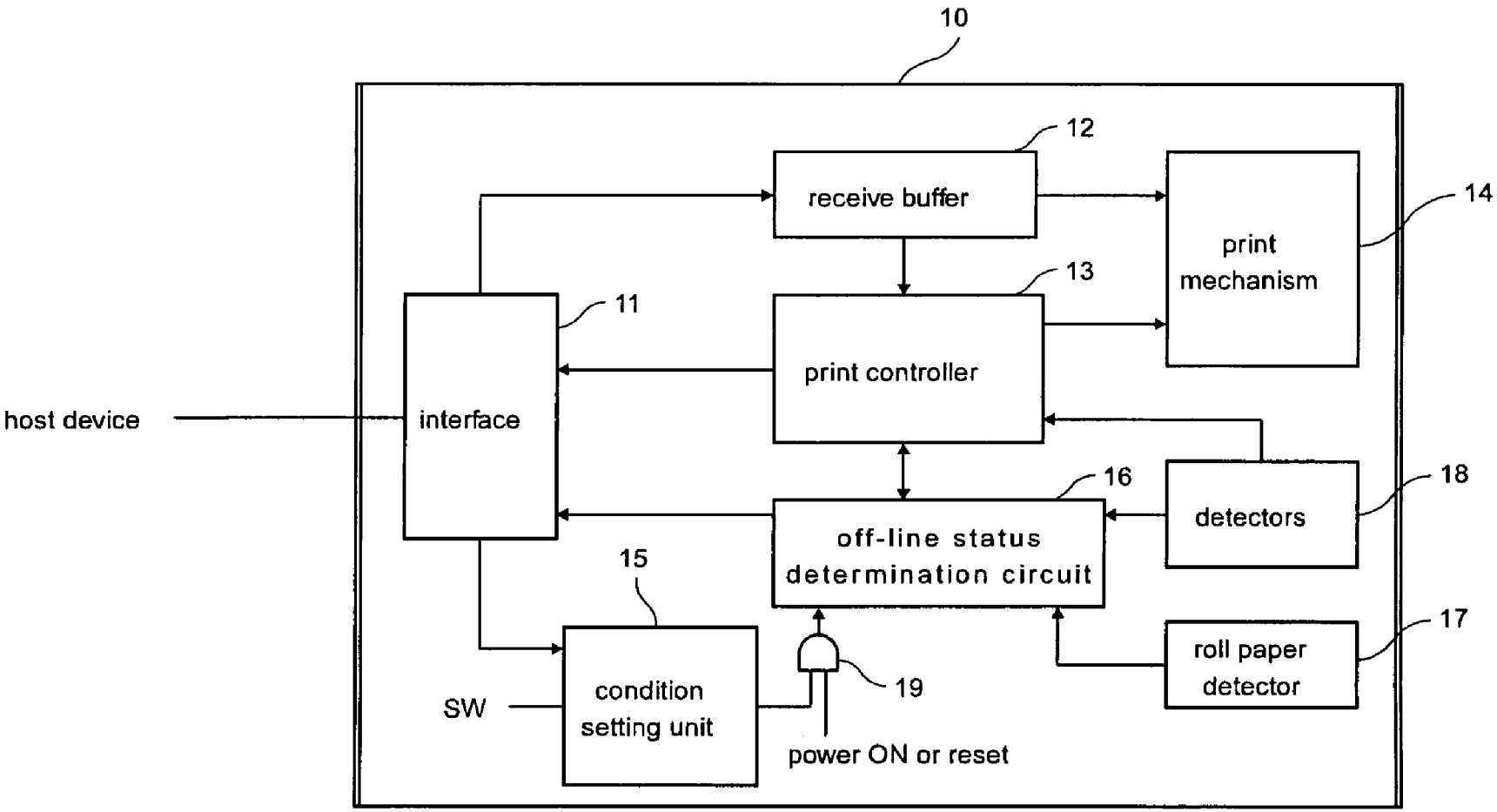
FIG. 3 is a function block diagram of a printer according to this embodiment of the invention.

FIG. 3 is a function block diagram of a printer according to a preferred embodiment of the present invention. Condition setting unit 15 can set or change the setting for whether the absence of roll paper 51 is or is not a condition for taking the printer off-line. This condition setting unit 15 could be a DIP switch or other physical switch, or it could be a flag or other logical switch stored in nonvolatile memory (nonvolatile storage means). If the condition setting unit 15 is a logical switch, the setting of the condition setting unit 15 can preferably be changed by an operation on an operating panel (not shown) of the printer. Convenience is further improved by enabling switching the setting of the condition setting unit 15 based on a command from a host device. By thus enabling using an operating panel or DIP switch to set the absence of roll paper as not a condition for taking the printer off-line, slips can be printed without loading roll paper 51 into the printer.

When the power turns on or is reset, the off-line conditions relating to roll paper are set in the off-line status determination circuit 16 according to the off-line conditions set by the condition setting unit 15. The AND gate 19 shown in the figure functionally denotes that the timing at which the off-line conditions of the off-line status determination circuit 16 are changed or set to the content of the condition setting unit 15 is when the power supply turns on or is reset, and does not mean that an AND gate is physically provided. Therefore, any desired configuration can be used insofar as the off-line determination conditions relating to roll paper are set in the off-line status determination circuit when the power turns on or is reset. Once the off-line conditions are set, whether to take the printer off-line or not is thereafter determined according to those set conditions until the next time the power is turned on or reset.

If there is the possibility of printing to both roll paper 51 and slip 60, the absence of roll paper 51 is set in the condition setting unit 15 as a condition for taking the printer off-line. When the power turns on or is reset, the off-line conditions are set in the off-line status determination circuit 16 according to the content of the condition setting unit 15. Once these off-line conditions are set, whether to take the printer off-line is determined according to the set conditions until the next time the power turns on or is reset.

If roll paper 51 is not loaded in the printer when the absence of roll paper 51 is set in the condition setting unit 15 as a condition for taking the printer off-line, the printer goes off-line when the power turns on, and printing to both roll paper 51 and slips 60 is disabled. If the roll paper 51 is loaded and no other off-line conditions are met, print commands and print data can be received from the host device. The received data is stored through an interface 11 to the receive buffer 12. The print controller 13 reads the received data from the receive buffer 12, and interprets the commands sent from the host device. If the received command is a print command, the following print data is developed in the print buffer not shown and printed by the print mechanism 14 to the selected printing paper, that is, roll paper 51 or slip 60.

If the absence of roll paper 51 is not in the condition setting unit 15 as a condition for taking the printer off-line, the off-line status determination circuit 16 does not take the printer off-line even if the roll paper detector 17 detects that there is no roll paper. The printer therefore does not go off-line even if there is no roll paper when the power turns on or is reset, and print commands can be received and processed. It is therefore possible to print to a slip 60 even when roll paper 51 is not loaded.

By thus setting the off-line conditions relating to the presence of roll paper 51 in the off-line status determination circuit 16 according to the setting of the condition setting unit 15 when the power turns on or is reset, slips can be printed even if roll paper 51 is not loaded when the power turns on by setting the absence of roll paper 51 in the condition setting unit 15 as not a condition for taking the printer off-line. It is therefore possible to print to slips without using roll paper in any way. It is therefore not necessary as it is with the prior art described above to load roll paper 51 that will never be used for printing, the loaded roll paper 51 will not be wasted when the power turns on, and unnecessary work and waste can be prevented.

Furthermore, by enabling the setting of the condition setting unit 15 to be changed from the operating panel or DIP switches of the printer 10, the setting of the condition setting unit 15 can be changed from the printer alone even if the printer is off-line. It is therefore not necessary to load roll paper in order to change the setting.

As also noted above, the setting of the condition setting unit 15 can be changed by a command sent from a host device. By setting the condition setting unit 15 as desired by the user at factory shipping or delivery so that absence of roll paper is not a condition for taking the printer off-line, the user can again print to slips without needing to purchase roll paper.

Figure 4:
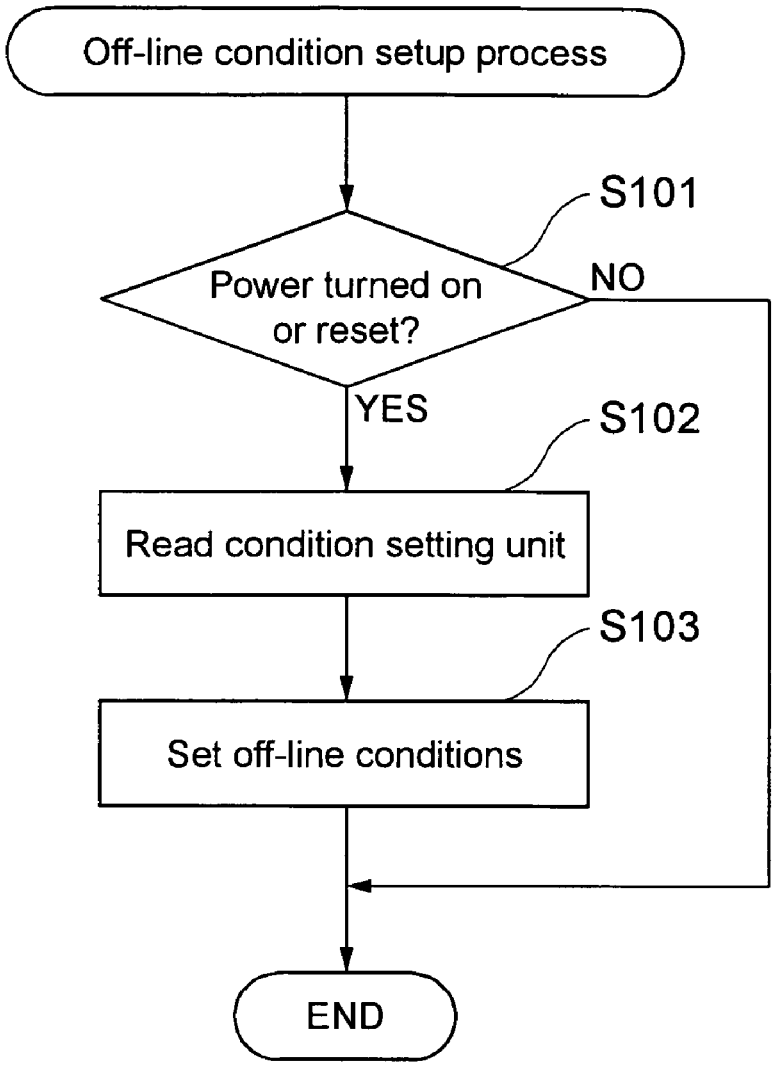
FIG. 4 is a flow chart of a process for setting the off-line conditions stored in the condition setting unit to the off-line status determination circuit.

FIG. 4 is a flow chart of the process for setting the off-line status determination circuit 16 to the off-line conditions set in the condition setting unit 15. These off-line conditions are set to the off-line status determination circuit 16 when the power turns on or is reset. The first step (S101) is therefore to determine if the power was turned on or reset. If the power was turned on or reset (S101 returns yes), the content of the condition setting unit 15 is read (S102), and the off-line conditions stored in the off-line status determination circuit 16 are set or changed according to the settings read from the condition setting unit 15 (S103). If the power was not turned on or reset (S101 returns no), the conditions are not set.

Figure 5:
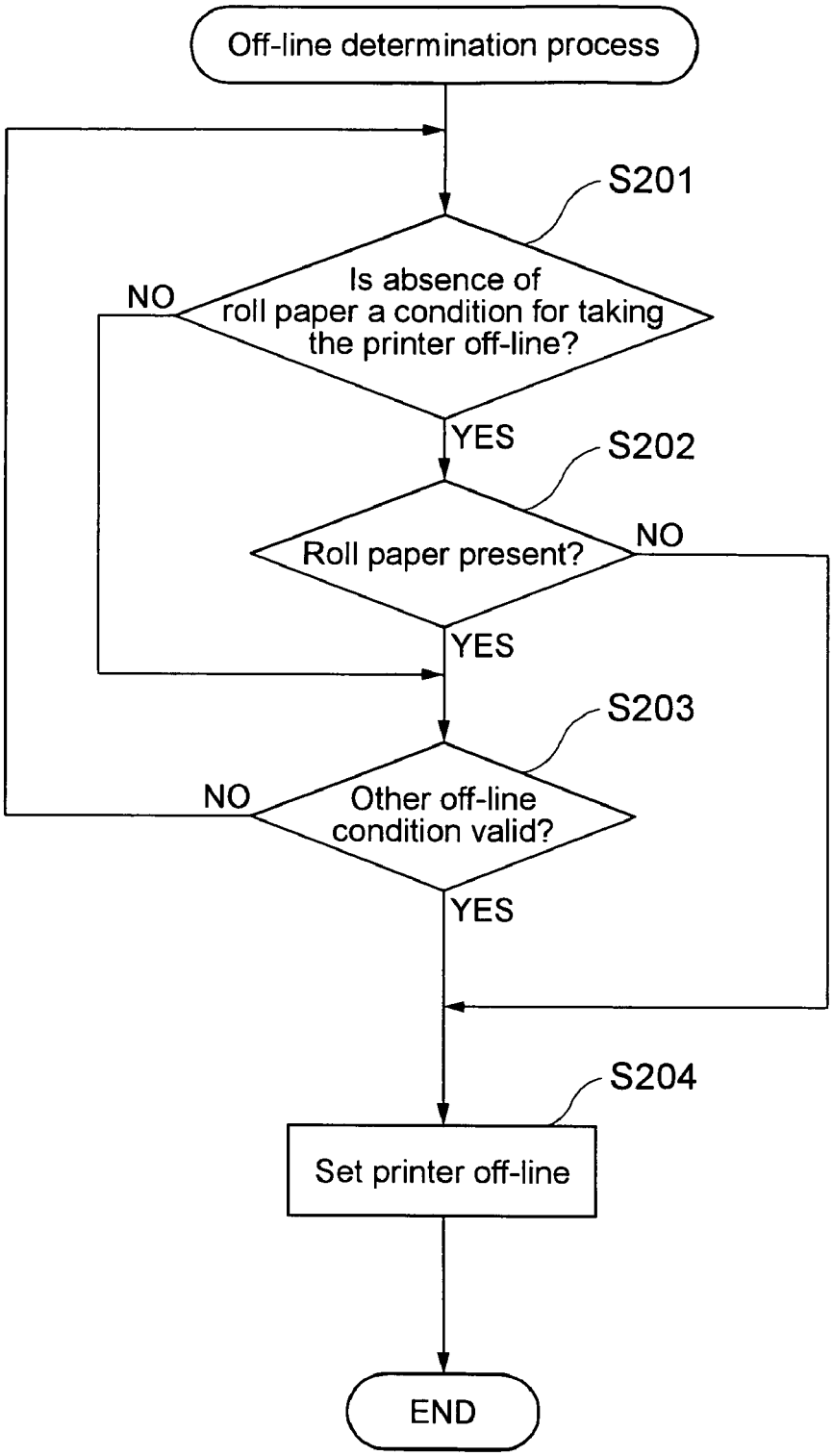
FIG. 5 is a flow chart for determining during printer operation whether to set the printer off-line.

FIG. 5 is a flow chart of a process for determining whether to take the printer off-line during printer operation. Whether absence of roll paper was set as a condition for taking the printer off-line when the power was turned on or reset is first determined (S201). If absence of roll paper is a condition for taking the printer off-line (S201 returns yes), whether roll paper is loaded or not is determined (S202). If there is no roll paper (S202 returns no), the printer is taken off-line (S204). When the printer is off-line, the host device cannot send print commands or print data to the printer, and any currently executing printing process is interrupted.

If absence of roll paper is not a condition for taking the printer off-line (S201 returns no), whether roll paper is loaded or is not loaded is ignored and the presence of roll paper is not checked (step S202 is skipped). Therefore, if roll paper is loaded (S202 returns yes), or absence of roll paper is not a condition for taking the printer off-line (S201 returns no), whether any other off-line conditions apply is determined (S203). If some other off-line condition applies (S203 returns yes), the printer is set off-line and data transmission from the host device is, in principle, disabled. If no other off-line conditions apply (S203 returns no), the printer is operating normally, and the same off-line determination process repeats (S201 to S203).

The print controller 13 could also ignore roll paper selection commands and print to slip 60 when a roll paper 51 selection command or roll paper print command is received from the application if the absence of roll paper 51 is not set as a condition for taking the printer off-line. If a roll paper 51 selection command is received in this situation, the print controller 13 could also return a status signal indicating that roll paper 51 cannot be used. If the print controller 13 returns such a status signal, the application must also be able to process the status signal.

Some printers also enable the host device to request the printer status. If the status controller or printer controller is configured in this situation to return a "roll paper loaded" status even though no roll paper is loaded, conventional applications can continue operating without modification insofar as the application does not request printing to roll paper.

Figure 6:
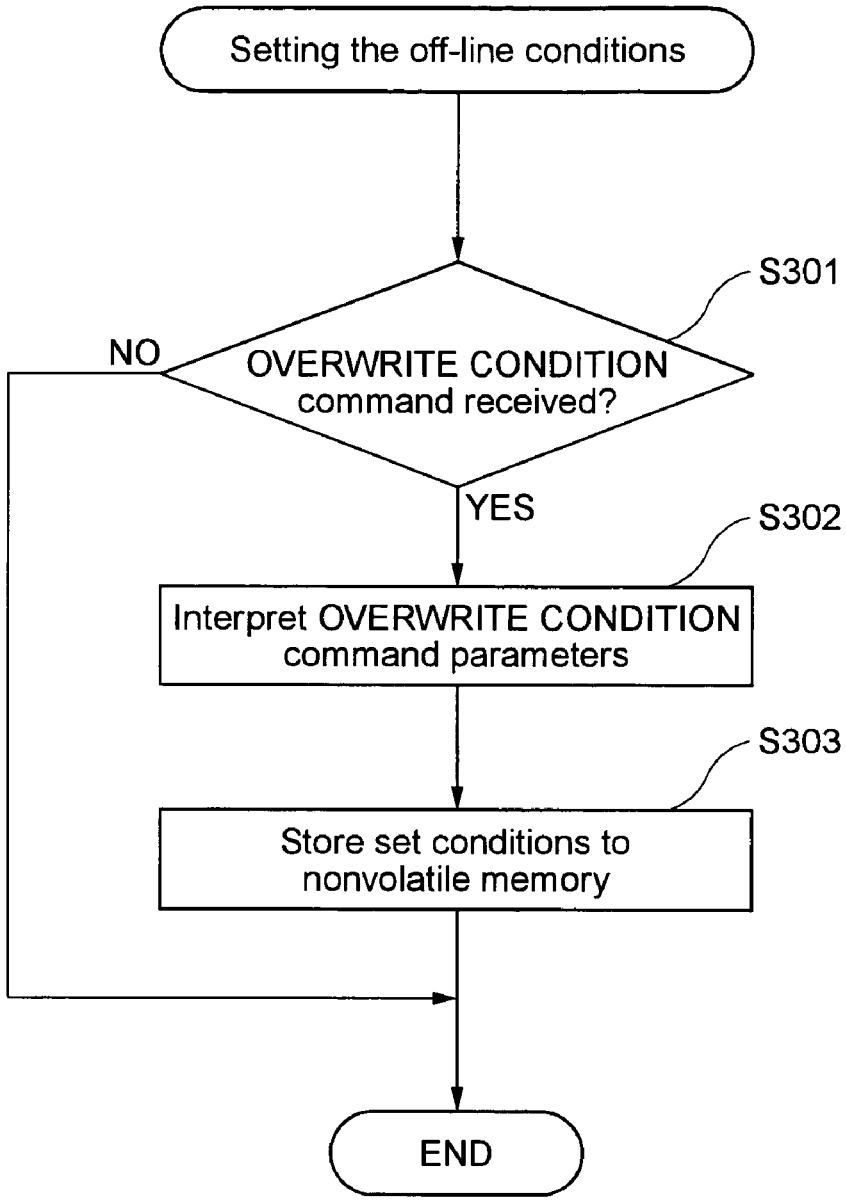
FIG. 6 is a flow chart of a setup process for changing the off-line conditions.

FIG. 6 is a flow chart of a setup process for changing the off-line conditions. The process shown in FIG. 6 asserts a command from the host device to overwrite the condition setting unit 15 (nonvolatile memory).

When an OVERWRITE CONDITION command is received from the host device (S301 returns yes), the parameters of the OVERWRITE CONDITION command are interpreted (S302). The off-line conditions are then changed by overwriting the content stored at a specified address in the nonvolatile memory based on the content interpreted from the command. Specific bits of the stored content are assigned to specific off-line conditions, such as "absence of roll paper is a condition for taking the printer off-line," and the conditions for setting the printer off-line are determined by the state of these particular bits. The off-line conditions stored in the nonvolatile memory (condition setting unit) are as described above, are read when the power is turned on or reset, stored to the off-line status determination circuit 16, and used to determine whether to set the printer to an off-line status during printer operation.

The invention has been described above using a printer that prints to both roll paper and slips by means of a single print head, but can obviously be applied in printers that use different print heads to print to roll paper, validation forms, slips, and other print media.

Effect Of the Invention

A printer according to the present invention thus has a condition setting unit enabling setting the absence of roll paper as not a condition for taking the printer off-line, and an off-line status determination circuit that does not set the printer off-line even when there is no roll paper if the absence of roll paper is set as not a condition for taking the printer off-line, and can print to both slips and roll paper, which is completely unnecessary when printing only to slips.

A normal (roll paper loaded) status could also be asserted by this printer regardless of whether roll paper is loaded or not, thereby enabling using a printer according to the present invention without changing conventional application programs.

The present invention thus enables printing only to slips when there is no expectation of using roll paper 51, and thus eliminates the need to purchase unnecessary and thus wasteful roll paper.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printing apparatus for printing to roll paper or slips, comprising:

a roll paper detector for detecting the presence or absence of roll paper;

a condition setting unit for setting or not setting the absence of roll paper as an output set condition for taking the printing apparatus off-line; and an off-line status controller determination circuit, responsive to power to the printing apparatus being turned on or the printing apparatus being reset, for determining whether or not to take the printing apparatus off-line based on the output set condition of the condition setting unit.

2. The printing apparatus as described in claim 1, wherein the condition setting unit comprises a logical switch for storing settings information in a nonvolatile storage medium.

3. The printing apparatus as described in claim 1, wherein the condition setting unit comprises a mechanical switch.

4. The printing apparatus as described in claim 3, wherein the condition setting unit comprises a DIP switch.

5. The printing apparatus as described in claim 1, wherein the off-line status controller determination circuit determines whether or not to take the printing apparatus off-line based on the output set condition of the condition setting unit and on the detection result of the roll paper detector.

6. The printing apparatus as described in claim 5, wherein the off-line status controller determination circuit comprises:

an off-line status determination circuit, responsive to power to the printing apparatus being turned on or the printing apparatus being reset, for generating an output based on the output set condition of the condition setting unit, and a print controller responsive to the output of the off-line status determination circuit for determining whether or not to take the printing apparatus off-line.

7. A control method for a printing apparatus for printing to roll paper or slips, having a roll paper detector for detecting the presence or absence of roll paper, the control method comprising:

(a) setting or not setting the absence of roll paper as an off-line condition of operation of the printing apparatus;

(b) confirming when power to the printing apparatus is turned on or the printing apparatus is reset and thereafter determining whether the absence of roll paper has been set as an off-line condition, and (c) taking the printing apparatus off-line when the determination in step (b) indicates that the absence of roll paper has been set as an off-line condition, or taking the printing apparatus on-line when the determination in step (b) indicates that the absence of roll paper has not been set as an off-line condition.

8. The control method for a printing apparatus as described in claim 7, further comprising:

(d) ignoring a roll paper selection command when roll paper absence is not set as an off-line condition of operation of the printing apparatus.

9. The control method for a printing apparatus as described in claim 8, further comprising:

(e) returning a roll paper present status in response to a roll paper status request regardless of actual roll paper detection if roll paper absence is not set as an off-line condition of operation of the printing apparatus.

10. The control method for a printing apparatus as described in claim 7, wherein the printing apparatus is taken off-line in step (c) when the determination in step (b) indicates that the absence of roll paper has been set as an off-line condition and the absence of roll paper has been detected.

11. A computer-readable recording medium carrying a program adapted to be executed on a computer which defines a control method for a printing apparatus inclusive of steps (a), (b) and (c) of claim 7.

* * * * *